US010429068B2

(12) United States Patent
Chian et al.

(10) Patent No.: US 10,429,068 B2
(45) Date of Patent: Oct. 1, 2019

(54) METHOD AND SYSTEM FOR STARTING AN INTERMITTENT FLAME-POWERED PILOT COMBUSTION SYSTEM

(71) Applicant: Ademco Inc., Golden Valley, MN (US)

(72) Inventors: Brent Chian, Plymouth, MN (US); Douglas Bird, Little Canada, MN (US); Peter Anderson, St. Paul, MN (US); Timothy J. Nordberg, Edina, MN (US); Thomas Johnson, Minneapolis, MN (US); Rolf L. Strand, Crystal, MN (US)

(73) Assignee: Ademco Inc., Golden Valley, MN (US)

( * ) Notice: Subject to any disclaimer, the term of this patent is extended or adjusted under 35 U.S.C. 154(b) by 264 days.

(21) Appl. No.: 15/340,657

(22) Filed: Nov. 1, 2016

(65) Prior Publication Data

US 2017/0115005 A1 Apr. 27, 2017

Related U.S. Application Data

(63) Continuation of application No. 13/740,114, filed on Jan. 11, 2013, now Pat. No. 9,494,320.

(51) Int. Cl.
*F23Q 5/00* (2006.01)
*F23Q 7/26* (2006.01)
(Continued)

(52) U.S. Cl.
CPC ..... *F23Q 5/00* (2013.01); *F23Q 7/26* (2013.01); *F24C 3/12* (2013.01); *F24H 1/186* (2013.01);
(Continued)

(58) Field of Classification Search
CPC ..... F23Q 7/26; F23Q 5/00; F24C 3/12; F24H 9/2035; F24H 2240/09; F24H 2240/08;
(Continued)

(56) References Cited

U.S. PATENT DOCUMENTS 3,174,535 A 3/1965 Weber
3,425,780 A 2/1969 Potts
(Continued)

FOREIGN PATENT DOCUMENTS

EP 0967440 A2 12/1999
EP 1039226 A2 9/2000
(Continued)

OTHER PUBLICATIONS

"A First Proposal to a Protocol of Determination of Boiler Parameters for the Annual Efficiency Method for Donestic Boilers," 2nd edition, 18 pages, Jul. 1998.
(Continued)

*Primary Examiner* — Alfred Basichas
(74) *Attorney, Agent, or Firm* — Shumaker & Sieffert, P.A.

(57) ABSTRACT

A flame powered intermittent pilot combustion controller may include a first power source and a second power source separate from the first power source, a thermal electric and/or photoelectric device, an igniter and a controller. The thermal electric and/or photoelectric device may charge the first power source when exposed to a flame. The controller and the igniter may receive power from the first power source when the first power source has sufficient available power, and may receive power from the second power source when the first power source does not have sufficient available power.

20 Claims, 4 Drawing Sheets

(51) Int. Cl.
*F24C 3/12* (2006.01)
*F24H 1/18* (2006.01)
*F24H 9/20* (2006.01)

(52) U.S. Cl.
CPC ..... *F24H 9/2035* (2013.01); *F24H 2240/08* (2013.01); *F24H 2240/09* (2013.01)

(58) Field of Classification Search
CPC . F24H 1/186; F23N 5/203; F23N 5/12; F23N 5/123; F23N 2023/08; F23N 2023/30; F23N 2029/00; F23N 2029/02; F23N 2027/30; F23N 2027/22; F23N 2031/08
See application file for complete search history.

(56) References Cited

U.S. PATENT DOCUMENTS 3,520,645 A 7/1970 Cotton et al.
3,574,496 A 4/1971 Hewitt
3,649,156 A 3/1972 Conner
3,681,001 A 8/1972 Potts
3,734,676 A 5/1973 Wyland
3,836,857 A 9/1974 Ikemgami et al.
3,877,864 A 4/1975 Carlson
3,887,325 A 6/1975 Finger et al.
3,909,816 A 9/1975 Teeters
4,033,711 A 7/1977 Christian et al.
4,131,413 A 12/1978 Ryno
4,157,506 A 6/1979 Spencer
4,221,557 A 9/1980 Jalics
4,242,079 A 12/1980 Matthews
4,269,589 A 5/1981 Matthews
4,280,184 A 7/1981 Weiner et al.
4,303,385 A 12/1981 Rudich, Jr. et al.
4,370,557 A 1/1983 Axmark et al.
4,450,499 A 5/1984 Sorelle
4,457,692 A 7/1984 Erdman
4,483,672 A 11/1984 Wallace et al.
4,518,345 A 5/1985 Mueller et al.
4,521,825 A 6/1985 Crawford
4,527,247 A 7/1985 Kaiser et al.
4,555,800 A 11/1985 Nishikawa et al.
4,622,005 A 11/1986 Kuroda
4,655,705 A 4/1987 Shute et al.
4,672,324 A 6/1987 Van Kampen
4,695,246 A 9/1987 Beilfuss et al.
4,709,155 A 11/1987 Yamaguchi et al.
4,770,629 A 9/1988 Bohan, Jr.
4,777,607 A 10/1988 Maury et al.
4,778,378 A 10/1988 Dolnick et al.
4,830,601 A 5/1989 Dahlander et al.
4,842,510 A 6/1989 Grunden et al.
4,843,084 A 6/1989 Parker et al.
4,904,986 A 2/1990 Pinckaers
4,906,177 A 3/1990 Newberry et al.
4,906,178 A 3/1990 Goldstein et al.
4,949,355 A 8/1990 Dyke et al.
4,984,981 A 1/1991 Pottebaum
5,026,270 A 6/1991 Adams et al.
5,026,272 A 6/1991 Takahashi et al.
5,035,607 A 7/1991 Peterson
5,037,291 A 8/1991 Clark
5,073,769 A 12/1991 Kompelien
5,077,550 A 12/1991 Cormier
5,090,895 A 2/1992 Jensen et al.
5,112,217 A 5/1992 Ripka et al.
5,126,721 A 6/1992 Butcher et al.
5,157,447 A 10/1992 Farnand et al.
5,174,743 A 12/1992 Wellman et al.
5,175,439 A 12/1992 Harer et al.
5,180,301 A 1/1993 Gross
5,222,888 A 6/1993 Jones et al.
5,236,328 A 8/1993 Tate et al.
5,251,815 A 10/1993 Foye
5,255,179 A 10/1993 Zekan et al.
5,261,609 A 11/1993 Roth
5,276,630 A 1/1994 Baldwin et al.
5,280,802 A 1/1994 Comuzie, Jr.
5,300,836 A 4/1994 Cha
5,346,391 A 9/1994 Fulleman et al.
5,347,982 A 9/1994 Binzer et al.
5,365,223 A 11/1994 Sigafus
5,368,230 A 11/1994 Oppenberg
5,391,074 A 2/1995 Meeker
5,423,479 A 6/1995 Nichols
5,424,554 A 6/1995 Marran et al.
5,446,677 A 8/1995 Jensen
5,472,336 A 12/1995 Adams et al.
5,506,569 A 4/1996 Rowlette
5,515,297 A 5/1996 Bunting
5,544,645 A 8/1996 Armijo et al.
5,567,143 A 10/1996 Servidio
5,599,180 A 2/1997 Peters et al.
5,636,981 A 6/1997 Lilly
5,682,329 A 10/1997 Seem et al.
5,722,823 A 3/1998 Hodgkiss
5,795,462 A 8/1998 Shurtleff
5,797,358 A 8/1998 Brandt et al.
5,899,684 A 5/1999 McCoy et al.
5,921,470 A 7/1999 Kamath
5,931,655 A 8/1999 Maher, Jr.
5,971,745 A 10/1999 Bassett et al.
6,004,127 A 12/1999 Heimberg et al.
6,060,719 A 5/2000 DiTucci et al.
6,071,114 A 6/2000 Cusack et al.
6,084,518 A 7/2000 Jamieson
6,092,738 A 7/2000 Becker
6,099,295 A 8/2000 McCoy et al.
6,119,954 A 9/2000 Kamath
6,129,284 A 10/2000 Adams et al.
6,135,366 A 10/2000 Bodelin et al.
6,222,719 B1 4/2001 Kadah
6,257,871 B1 7/2001 Weiss et al.
6,260,773 B1 7/2001 Kamath
6,261,086 B1 7/2001 Fu
6,261,087 B1 7/2001 Bird et al.
6,299,433 B1 10/2001 Gauba et al.
6,346,712 B1 2/2002 Popovic et al.
6,349,156 B1 2/2002 O'Brien et al.
6,356,827 B1 3/2002 Davis et al.
6,385,510 B1 5/2002 Hoog et al.
6,457,692 B1 10/2002 Gohl, Jr.
6,474,979 B1 11/2002 Rippelmeyer
6,478,573 B1 11/2002 Chian
6,486,486 B1 11/2002 Haupenthal
6,509,838 B1 1/2003 Payne et al.
6,552,865 B2 4/2003 Cyrusian
6,561,792 B1 5/2003 Pfund
6,676,404 B2 1/2004 Lochschmied
6,684,821 B2 2/2004 Lannes et al.
6,700,495 B2 3/2004 Mindermann et al.
6,701,874 B1 3/2004 Schultz et al.
6,743,010 B2 6/2004 Bridgeman et al.
6,782,345 B1 8/2004 Siegel et al.
6,794,771 B2 9/2004 Orloff
6,829,123 B2 12/2004 Legatti et al.
6,881,055 B2 4/2005 Bird
6,912,671 B2 6/2005 Christensen et al.
6,917,888 B2 7/2005 Loginov et al.
6,920,377 B2 7/2005 Chian
6,923,640 B2 8/2005 Canon
6,953,161 B2 10/2005 Laursen et al.
7,088,137 B2 8/2006 Behrendt et al.
7,088,253 B2 8/2006 Grow
7,202,794 B2 4/2007 Huseynov et al.
7,241,135 B2 7/2007 Munsterhuis et al.
7,252,502 B2 8/2007 Munsterhuis
7,255,285 B2 8/2007 Troost et al.
7,274,973 B2 9/2007 Nichols et al.
7,289,032 B2 10/2007 Seguin et al.
7,327,269 B2 2/2008 Kiarostami
7,617,691 B2 11/2009 Street et al.
7,728,736 B2 6/2010 Leeland et al.
7,764,182 B2 7/2010 Chian et al.

(56) References Cited

U.S. PATENT DOCUMENTS

| | | | |
|---|---|---|---|
| 7,768,410 | B2 | 8/2010 | Chian |
| 7,800,508 | B2 | 9/2010 | Chian et al. |
| 7,944,678 | B2 | 5/2011 | Kaplan et al. |
| 8,066,508 | B2 | 11/2011 | Nordberg et al. |
| 8,070,482 | B2 | 12/2011 | Fuentes et al. |
| 8,074,892 | B2 | 12/2011 | Bracken et al. |
| 8,085,521 | B2 | 12/2011 | Chian |
| 8,123,517 | B2 | 2/2012 | Peruch |
| 8,177,544 | B2 | 5/2012 | Anderson |
| 8,297,524 | B2 | 10/2012 | Kucera et al. |
| 8,300,381 | B2 | 10/2012 | Chian et al. |
| 8,310,801 | B2 | 11/2012 | McDonald et al. |
| 8,512,034 | B2 | 8/2013 | Young et al. |
| 8,523,560 | B2 | 9/2013 | Anderson et al. |
| 8,632,017 | B2 | 1/2014 | Kucera et al. |
| 8,659,437 | B2 | 2/2014 | Chian |
| 8,780,726 | B2 | 7/2014 | Anglin et al. |
| 8,875,557 | B2 | 11/2014 | Chian et al. |
| 9,388,984 | B2 | 7/2016 | Anderson |
| 9,494,320 | B2 | 11/2016 | Chian et al. |
| 9,718,417 | B2 | 8/2017 | Singh |
| 2002/0099474 | A1 | 7/2002 | Khesin |
| 2003/0064335 | A1 | 4/2003 | Canon |
| 2003/0222982 | A1 | 12/2003 | Hamdan et al. |
| 2004/0209209 | A1 | 10/2004 | Chodacki et al. |
| 2005/0086341 | A1 | 4/2005 | Enga et al. |
| 2006/0084019 | A1 | 4/2006 | Berg et al. |
| 2006/0257805 | A1 | 11/2006 | Nordberg et al. |
| 2007/0143000 | A1 | 6/2007 | Bryant et al. |
| 2007/0159978 | A1 | 7/2007 | Anglin et al. |
| 2007/0188971 | A1 | 8/2007 | Chian et al. |
| 2009/0009344 | A1 | 1/2009 | Chian |
| 2009/0017406 | A1 | 1/2009 | Farias Fuentes et al. |
| 2010/0013644 | A1 | 1/2010 | McDonald et al. |
| 2010/0075264 | A1 | 3/2010 | Kaplan et al. |
| 2010/0199640 | A1 | 8/2010 | Kodo |
| 2010/0265075 | A1 | 10/2010 | Chian |
| 2011/0045423 | A1 | 2/2011 | Young et al. |
| 2011/0048340 | A1 | 3/2011 | Anderson et al. |
| 2011/0247604 | A1 | 10/2011 | Anderson et al. |
| 2011/0250546 | A1 | 10/2011 | Anderson |

FOREIGN PATENT DOCUMENTS

| | | | |
|---|---|---|---|
| EP | 1148298 | A1 | 10/2001 |
| GB | 1509704 | A | 5/1978 |
| GB | 2193758 | A | 2/1988 |
| WO | 9718417 | | 5/1997 |
| WO | 0171255 | A1 | 9/2001 |
| WO | 2011031263 | A1 | 3/2011 |

OTHER PUBLICATIONS

"Results and Methodology of the Engineering Analysis for Residential Water Heater Efficiency Standards," 101 pages, Oct. 1998.
Aaron and Company, "Aaronews," vol. 27 No. 6, 4 pages, Dec. 2001.
Beckett Residential Burners, "AF/AFG Oil Burner Manual," 24 pages, Aug. 2009.
Dungs, "Automatic Gas Burner Controller for Gas Burners with or without fan," Edition 10.08, 6 pages, downloaded Mar. 25, 2013.
Honeywell, "S4965 Series Combined Valve and Boiler Control Systems," 16 pages, prior to 2009.
Honeywell, "S923F1006 2-Stage Hot Surface Ignition Integrated Furnace Controls, Installation Instructions," 20 pages, 2006.
Honeywell, "SV9410/SV9420; SV9510/SV9520; SV9610/SV9620 Smart Valve System Controls," Installation Instructions, 16 pages, 2003.
Robertshaw, "Control Tips," 3 pages, 2010.
Tradeline, "Oil Controls, Service Handbook," 84 pages, prior to Apr. 9, 2010.
Underwriters Laboratories Inc. (UL), "UL 296, Oil Burners," ISBN 1-55989-627-2, 107 pages, Jun. 30, 1994.
Vaswani et al., "Advantages of Pulse Firing in Fuel-Fired Furnaces for Precise Low-Temperature Control," downloaded from: www.steelworld.com/tecmay02.htm, 6 pages, Mar. 25, 2013.
Wu et al., "A Web 2.0-Based Scientific Application Framework," 7 pages, Jan. 22, 2013.
www.playhookey.com, "Series LC Circuits," 5 pages, printed Jun. 15, 2007.

METHOD AND SYSTEM FOR STARTING AN INTERMITTENT FLAME-POWERED PILOT COMBUSTION SYSTEM

This application is a continuation of co-pending U.S. application Ser. No. 13/740,114, filed Jan. 11, 2013, and entitled "Method And System For Starting An Intermittent Flame-Powered Pilot Combustion System", which is incorporated herein by reference.

TECHNICAL FIELD

The present disclosure relates generally to intermittent flame-powered pilot combustion systems, and more particularly to systems and methods for starting up an intermittent flame-powered pilot combustion system.

BACKGROUND

Energy efficiency is increasingly important for gas-powered appliances, such as hot water heaters, space heaters, and furnaces. In many gas-powered appliances, a flame powered combustion controller is used, where energy from a standing pilot flame is used to power the combustion controller. Thus, no external power source may be required. However, many such systems, if the pilot flame is extinguished, power is lost to the combustion controller.

To improve energy efficiency, intermittent pilot systems have been developed. Intermittent pilot systems typically have a spark ignition system that ignites a pilot flame during each call for heat to the gas-powered appliance. Once the pilot flame is ignited, a main valve of the gas-powered appliance may be activated, allowing the pilot flame to ignite a main burner. Once the call for heat is satisfied, the main burner and pilot flame may be extinguished, thereby saving energy and cost.

Intermittent pilot systems often obtain electrical power after a successful ignition sequence from a thermoelectric device (e.g., a thermopile) capable of generating electricity using the flame from the pilot burner, the main burner, or both. In some cases, electrical energy from the thermoelectric device may be stored in an energy storage device (e.g., a capacitor), which can be used to ignite the pilot flame in response to a subsequent call for heat.

Upon initial installation, or after an extended period of non-use, the energy storage device (e.g., a capacitor) may not store sufficient charge to ignite the pilot flame and/or power the combustion controller. Because of this, many intermittent pilot systems include a piezo igniter. In many such systems, a user is required to manually depress a button to activate the piezo igniter, while at the same time hold down a gas button to open the pilot valve. Once the pilot flame is ignited, the user must continue to hold down the gas button until the pilot flame can heat a thermoelectric device (e.g., a thermopile) or activate a photoelectric device sufficiently to generate enough power to hold the pilot valve open, which in some cases, can take an extended period of time. This procedure can be inconvenient, tedious and error prone for a user.

SUMMARY

The present disclosure relates generally to intermittent flame-powered pilot combustion systems, and more particularly to systems and methods for starting up an intermittent flame-powered pilot combustion system.

In some instances, a flame-powered intermittent pilot combustion controller may include a first power source and a second power source separate from the first power source, a thermoelectric and/or photoelectric device that charges the first power source when the thermal electric device is exposed to a flame, an igniter, and a controller. In some cases, the flame powered intermittent pilot combustion controller may be installed in an appliance, and the second power source may be pre-charged prior to installation of the appliance in the field (e.g. at a customer site). The controller and/or the igniter may receive power from the first power source when the first power source has sufficient available power. The controller and/or the igniter may receive power from the second power source when the first power source does not have sufficient power. In some cases, the flame-powered intermittent pilot combustion controller may include a momentary switch coupled to the second power source. Activation of the momentary switch by a user may cause the controller to receive power from the second power source and to initiate a pilot flame sequence. In some cases, the controller and/or igniter may receive power from a rechargeable power source, wherein the rechargeable power source may be pre-charged before and/or during installation. The rechargeable power source may be installed in the gas-fired appliance before and/or during installation.

In some instances, a gas-powered appliance may include an intermittent pilot ignition system. The intermittent pilot ignition system may include a pre-charged power source, a rechargeable energy storage device, a burner assembly, and a controller. The pre-charged charged power source may be pre-charged prior to installation of the gas-powered appliance in the field, and the rechargeable energy storage device may be configured to be charged using energy generated by a thermal electric and/or photoelectric device associated with the burner assembly. The controller may initiate ignition of the pilot flame using the pre-charged power source when the energy stored in the rechargeable energy storage device is below a threshold level, and may use energy from the rechargeable energy storage device when the energy stored in the rechargeable energy storage device is above the threshold level.

An illustrative technique for igniting a pilot flame of a gas-powered appliance having a flame powered intermittent pilot ignition system for a first time after installation may include using power from a first energy storage device to ignite the pilot flame of the gas-powered appliance for a first time after installation. During subsequent operation of the gas-powered appliance, power from a second energy storage device, different from the first energy storage device, may be used to ignite the pilot flame of the gas-powered appliance. After an extended duration of non-use, the gas-powered appliance may use power from the first energy storage device to ignite the pilot flame when the power stored in the second energy storage device falls below a specified threshold.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following description of various embodiments in connection with the accompanying drawings, in which.

Figure 1:
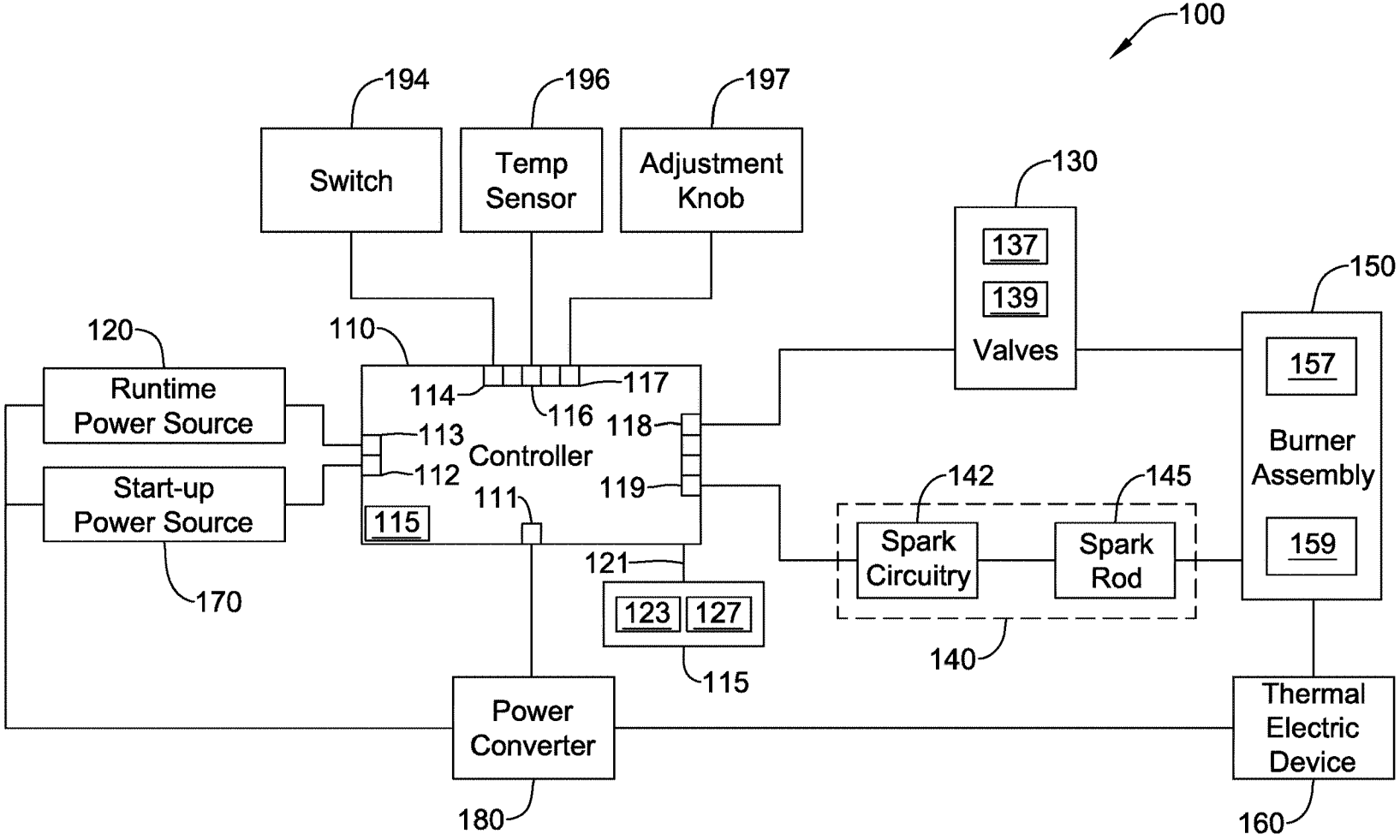
FIG. 1 is a schematic view of an illustrative intermittent pilot combustion controller and system.

While the disclosure is amenable to various modifications and alternative forms, specifics thereof have been shown by way of example in the drawings and will be described in detail. It should be understood, however, that the intention is not to limit the disclosure to the particular illustrative embodiments described. On the contrary, the intention is to cover all modifications, equivalents, and alternatives thereof.

DESCRIPTION

The following description should be read with reference to the drawings wherein like reference numerals indicate like elements throughout the several views. The description and drawings show several embodiments which are meant to illustrative in nature.

FIG. 1 is a schematic view of an illustrative intermittent pilot combustion controller and system 100. The intermittent pilot combustion controller and system 100 may be used, for example, for igniting an intermittent pilot flame of a burner assembly 150 of a gas-powered appliance, such as a water heater, a boiler, a furnace and the like. In some cases, the intermittent pilot combustion controller and system 100 may include a controller 110, one or more first power sources (e.g., a runtime power source 120), one or more second power sources (e.g., a start-up power source 170), at least one thermal electric and/or photoelectric device 160, an igniter 140, and a burner assembly 150. In some cases, the igniter 140 may include spark circuitry 142 capable of converting electrical energy having a first voltage (e.g., a voltage of a low voltage power source) to a second higher voltage used by the spark rod 145 to create a spark for ignition of a pilot flame. The burner assembly 150 may include a pilot burner 157 and a main burner 159, which may be located within a combustion chamber 152.

The controller 110 and/or the igniter 140 may receive power from the runtime power source 120 when the runtime power source 120 has sufficient available power. The controller 110 and/or the igniter 140 may receive power from the start-up power source 170 when the runtime power source 120 does not have sufficient available power. When at least one of the pilot burner 157 or the main burner 159 is operational, the thermal electric and/or photoelectric device 160 may be used to power the controller 110, to charge the runtime power source 120 and/or to charge the start-up power source 170, as desired. In some cases, energy provided by the thermal electric and/or photoelectric device 160 may be adjusted using one or more power converters 180.

In some cases, the intermittent pilot combustion controller and system 100 may be used within a gas-powered appliance for controlling the burner assembly 150 to maintain a specified temperature, such as a specified water temperature, a specified air temperature, etc. For example, the intermittent pilot combustion controller and system 100 may be used in a water heater to maintain water in the water heater at a specified temperature. In some cases, the controller 110 may be configured to receive a specified temperature set point from a user, such as by using an adjustment element 197 or the like. The controller 110 may be programmed to maintain the water temperature in the water heater at the specified set point temperature by using a sensed water temperature received from one or more temperature sensor(s) 196. To maintain the set point, the controller 110 may command the igniter 140 to ignite a flame in the burner assembly 150. During the ignition sequence, the controller 110 may command a pilot valve 137 to open to supply gas to the pilot burner 157. Once gas is present at the pilot burner 157, the controller 110 may command the igniter 140 to ignite a flame at the pilot burner 157. The controller 110 may then command the main valve 139 to open to allow ignition of a main flame of the main burner 159 using the pilot flame.

The illustrative controller 110 may include one or more inputs 111, 112, 113, 114, 116, 117 and/or one or more outputs 118, 119. In some cases, the inputs 111, 112, 113 may be configured to receive power from one or more energy sources, such as the runtime power source 120, the start-up power source 170 and/or one or more thermal electric and/or photoelectric device 160. The power may be used for powering the controller 110 and/or the igniter 140. In some cases, one or more characteristics (e.g., a voltage level, a current level, etc.) of the energy received from the thermal electric and/or photoelectric device 160 may be adjusted (e.g., to a higher voltage level, to a lower level, etc.), such as by using the power converter 180. In some cases, the power converter 180 may be used to convert a voltage from a first voltage level to a second voltage level for use by one or more electronic circuits (e.g., the controller 110), such as from about 200 millivolts to about 3 Volts. In some cases, the power converter 180 may be used to convert a voltage from the first voltage level or the second voltage level to a third voltage level for use by another electronic circuit (e.g., the igniter 140), such as from about 3 Volts to about 170 Volts. The power converter 180 may be connected directly to one or more power sources (e.g., the runtime power source 120, the start-up power source 170, the thermal electric and/or photoelectric device 160, etc.) or via one or more electrical circuits, such as the controller 110. The power converter 180 may include one or more DC-DC voltage converter(s), such as a linear converter or a switched-mode converter. In some cases, the power converter 180 may include one or more buck converters, boost converters, buck-boost converters, single-ended primary inductor converters (SEPIC), auk converters, or the like. In some cases, the power converter 180 may include conditioning circuitry, such as a regulator and/or a filter (e.g., a low pass filter, a high pass filter, a band pass filter, a band-stop filter, etc.) to provide a regulated DC voltage.

The inputs 114, 116, 117 of the controller 110 may receive one or more user commands and/or an output from one or more sensors. In the example shown, the inputs 114 may be configured to receive a user command from a switch (e.g., a momentary switch 194), such as to command the controller to ignite a pilot flame. The inputs 117 may be configured to receive temperature set point information, such as by using an adjustment element 197. Inputs 116 may be configured to receive sensor signals (e.g., temperature feedback signals) received from one or more sensors (e.g., one or more temperature sensors) associated with the intermittent pilot combustion controller and system 100.

In some cases, the runtime power source 120 may be capable of providing power for the intermittent pilot combustion controller and one or more other components of the system 100 during normal operation. For example, controller 110, the pilot valve 137 and the igniter 140 may receive electrical energy from the runtime power source 120 during an ignition sequence of the pilot burner 157. The runtime power source 120 may be integrated within a gas powered appliance and may be capable of being recharged by receiving and storing power received from the thermal electric and/or photoelectric device 160. The runtime power source 120 may include one or more devices capable of storing electrical energy, such as a capacitor, a rechargeable battery, one or more series connected batteries and/or another device capable of storing electrical energy. In some cases, the runtime power source 120 may be charged to a specified voltage prior to installation of the associated gas-powered appliance.

Over time, such as during an extended duration when the gas-powered appliance is off, the energy stored by the runtime power source 120 may discharge. In other cases, such as after one or more failed ignition sequences of the pilot burner 157 and/or the main burner 159, the energy stored by the runtime power source 120 may be depleted by multiple sparks generated by the spark rod 145 of the igniter 140. In one example, the spark circuitry 142 may include a DC to DC converter as discussed above. When the stored energy level of the runtime power source 120 is below a specified threshold (e.g., a specified voltage), the controller 110 may be configured to receive power from the start-up power source 170. In some cases, the threshold for the voltage may be set using one or more discrete electrical components, such as one or more resistors, capacitors, inductors, diodes, transistors, and/or integrated circuits, such as a comparator and/or a processor. In some cases, the controller 110 may read the threshold from a memory 115 and/or compute the threshold using one or more instructions stored in the memory 115. In some cases, the specified threshold may be fixed at a pre-determined level. In other cases, the specified threshold may be configurable and/or adaptable, as desired.

As discussed above, the controller 110 may be configured to receive power from the start-up power source 170, such as when insufficient energy is stored in the runtime power source 120, such as during an initial power-up sequence after installation and/or after an extended duration of non-use of the associated gas-powered appliance and/or repeated trials without success (e.g., a gas outage). The start-up power source 170 may be pre-charged before installation. For example, a manufacturer or an installer may provide one or more charged batteries and/or pre-charge a capacitor before installing the gas-powered appliance. In some cases, one or more start-up power sources 170 may be provided external to and/or integrated with to a gas-powered appliance. Examples of the one or more types of start-up power sources 170 may include batteries, capacitors, an AC line adapter (e.g., an AC-to-DC converter), a generator (e.g., a hand-crank generator).

In some cases, a pre-charged power source may include an energy storage device storing a specified amount of energy, an energy generation device, and/or an AC line adapter receiving power from an electrical generation device. In some cases, power source may include two or more series-connected batteries, where one or more of the series-connected batteries may be used as the runtime power source 120 and another one or more of the series-connected batteries may be used as the start-up power source 170.

In some cases, it is contemplated that a damper may be used as the start-up power source 170. For example, a gas-powered device may include a damper on an exhaust vent for controlling ventilation. In such cases, the controller 110 may include one or more outputs to control the operation of the damper using a motor. Some motors (e.g., a permanent magnet motor, a stepper motor, etc.) may be used to generate electricity when mechanically driven. For example, a stepper motor used to control the damper may be mechanically driven (e.g., by hand, using a drill, etc.) to spin at specified rate (e.g., between about 200 RPM to about 1000 RPM, etc.) for producing an alternating voltage. In such cases, the start-up power source 170 may include circuitry (e.g., a filter, a rectifier, a power converter, etc.) to convert the AC energy produced by the damper motor to a voltage at a specified voltage and/or current to be used by the controller 110, at least until the thermal electric and/or photoelectric device 160 can provide sufficient power after ignition.

The controller 110 may operate using an algorithm stored in the memory 115 that controls or at least partially controls one or more components of a gas-powered appliance, such as the igniter 140 and/or one or more valves supplying fuel to the burner of the burner assembly 150 of a gas-powered appliance. In some cases, the controller 110 may operate using an algorithm that controls one or more parameters of an ignition sequence of the igniter 140, such as the timing of sparks, energy levels of the sparks generated by the igniter 140 and/or managing energy levels of one or more energy sources providing power to the intermittent pilot combustion controller system (e.g., the runtime power source 120, the start-up power source 170, the thermal electric and/or photoelectric device 160, a power converter 180, etc.). In some cases, the controller 110 may use the energy generated by the thermal electric and/or photoelectric device 160 to monitor the operation of the pilot burner 157, the main burner 159, or both. For example, the controller 110 may determine the success or failure of a particular ignition attempt, such as by monitoring whether the thermal electric and/or photoelectric device 160 produces energy within a predetermined amount of time. In one example, the controller 110 may include a microcontroller, such as a PIC microcontroller, an ARM-core microcontroller, or the like, and may be configured to operate an algorithm using an embedded operating system. In some cases, the controller 110 may be configured to be reprogrammed via a communication port (not shown). In some cases, the intermittent pilot combustion controller and system 100 may include a timer (not shown). When provided, the timer may be integral to the controller 110 or may be provided as a separate component.

The memory 115 of the illustrative intermittent pilot combustion controller and system 100 may communicate with the controller 110. In some cases, the memory 115 may be integral to the controller 110, included as a separate memory device, or both. The controller 110 may communicate with the memory 115 via one or more data lines, such as the data bus 121. The memory 115 may be used to store any desired information, such as the aforementioned control algorithm, set points, schedule times, limits such as, for example, voltage limits, temperature limits, spark energy limits, and the like. In some cases, the memory 115 may include a portion 123 for storing instructions, such as the ignition sequence algorithm, and a data portion 127 for storing information about the ignition sequence (e.g., one or more thresholds, a spark voltage level, a time delay, a purge time, a number of reties, etc). The memory 115 may be any suitable type of storage device including, but not limited to, RAM, ROM, EEPROM, flash memory, a hard drive, and/or the like. In some cases, controller 110 may store information within the memory 115, and may subsequently retrieve the stored information.

Figure 2:
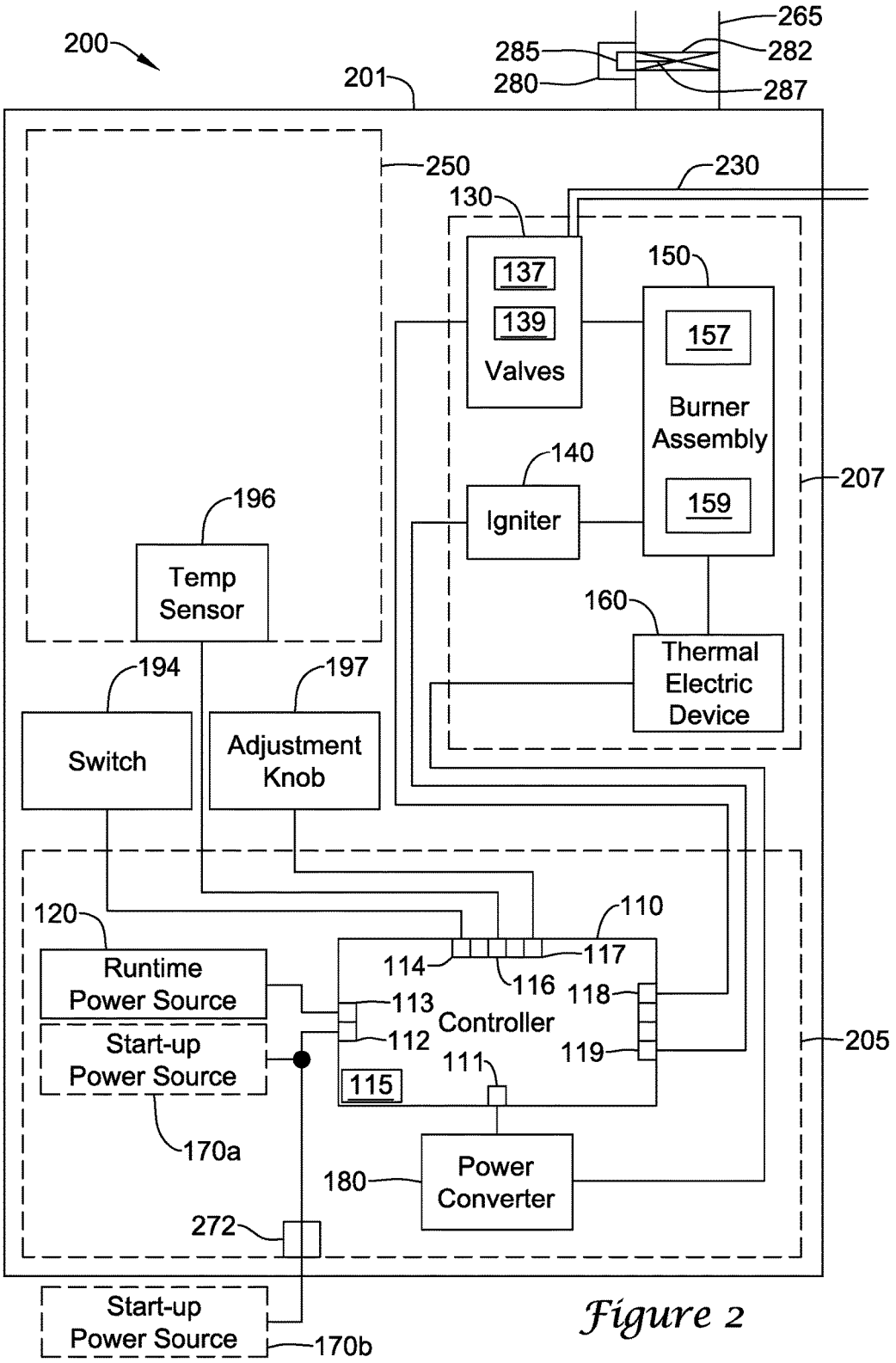
FIG. 2 is a schematic view of another illustrative intermittent pilot combustion controller and system.

FIG. 2 is a schematic view of another illustrative intermittent pilot combustion controller and system 200. The illustrative intermittent pilot combustion controller and system 200 may be a water heater 201, a tank-less water heater, a boiler, a furnace, a space heater, a fireplace, or any other suitable gas-powered appliance having an intermittent pilot ignition system. While not limiting, the illustrative intermittent pilot combustion controller and system 200 may be described as an illustrative water heater 201, which has a control section 205, a heating section 207, and a water tank 250, and may include one or more components of the intermittent pilot combustion controller and system 100 of FIG. 1. In some cases, the control section 205 may include the controller 110 of FIG. 1, one or more power sources, such as runtime power source 120, start-up power source 170 (e.g., the ignition start-up power sources 170A, 170B), and power converter 180. The heating section 207 may include the burner assembly 150 (e.g., the pilot burner 157, the main burner 159, etc.), one or more valves 130 (e.g., the pilot valve 137, the main valve 139), igniter 140, and the thermal electric and/or photoelectric device 160.

In the example shown, an adjustment element 197 (e.g. knob, button, etc.) may be coupled to the control section 205. A user may use the adjustment element 197, for example, to define a temperature set point for the water heater 201. The controller 110 may receive the temperature set-point from the adjustment element 197 via the inputs 117. The temperature of the water in the water tank 250 may be regulated by the controller 110 using temperature information received at inputs 116 from one or more temperature sensors 196, which is thermally coupled to the water tank 250. In the example shown, the controller 110 may control the operation of the burner assembly 150 to regulate the temperature of the water in the water tank 250 at and/or near a desired set-point temperature.

Fuel, such as natural gas, propane, butane and/or other fossil fuels, may be supplied to the water heater 201 using a fuel supply connection (e.g., a fuel supply line 230) from a fuel source (not shown). The controller 110 may control the fuel supplied to the burner assembly 150 using one or more valves 130. The valves 130 may be used to provide fuel from the fuel supply line 230 to the pilot burner 157 and/or the main burner 159. Typically, the pilot burner 157 is lit first. Once the pilot burner 157 is lit, the controller 110 may ignite the main burner 159 from the pilot burner 157. The main burner 159 may provide the necessary heat to increase the temperature of the desired medium to be heated (e.g., air, water, etc.), such as water in the water tank 250 of the water heater 201.

The intermittent pilot combustion controller and system 200 may include an exhaust vent 265 for exhausting emissions from the combustion of the gas supplied to the burner assembly 150. The vent 265 may be fluidly coupled to the burner assembly 150, and may be configured to exhaust the emissions to a venting area, such as a location outside of a building and/or structure in which the gas-powered appliance is installed. In some cases, a damper 280 may be associated with the exhaust vent 265 to help improve energy efficiency of the intermittent pilot combustion controller and system 200. The controller 110 may command the damper 280 to open before initiating an ignition sequence for the burner assembly 150, and to remain open until, or briefly after, the flame is extinguished in the burner assembly 150. The damper 280 may be supported, at least in part, by the exhaust vent 265, and may include one or more plates 282 that may be rotated so that the flow of the emissions from the burners of the burner assembly 150 may be controlled. For example, the controller 110 may command the plates 282 of the damper 280 to be positioned at a first position (e.g., a more open position). The plates 282 may remain at that first position until the controller 110 commands the plates 282 to be moved to a different second position (e.g., a more closed position). For example, if the electrical connection to the damper is lost, the plates 282 may remain in the same position. In some cases, the plates 282 of the damper 280 may be configured to be "normally closed", such that damper 280 may be closed when the burners of the burner assembly 150 are off. This may help reduce heat from escaping through the exhaust vent between cycles. In some cases, the damper 280 may be held open using energy provided by the thermal electric and/or photoelectric device 160.

The loss of electric power from the thermal electric and/or photoelectric device 160 may be used by the controller 110 as an indication that one or more of the pilot burner and/or main burner is not lit. In such cases, the controller 110 may command the damper 280 to close or to another known position. In some cases, the damper may remain at its current position at the loss of electrical energy from the thermal electric and/or photoelectric device 160. In other cases, the loss of electrical energy from the thermal electric and/or photoelectric device 160 may directly cause the damper 280 to return to its "normally closed" position.

In some cases, the damper 280 may include a motor 285 (e.g., a stepper motor, a permanent magnet motor, etc.) that rotates the plates 282 of the damper 280 between a more open and a more closed position. The motor 285 may be mounted to a mounting plate adjacent to the exhaust vent 265, and may be electrically connected to the controller 110. A motor shaft 287 may be mechanically coupled to the plates 282 for rotating the plates 282 from a first position (e.g., the normally closed position) to a second position (e.g., an open position). In some cases, the motor shaft 287 may be directly coupled to the plates 282 and in other cases may be mechanically coupled to the plates 282 using a gear assembly (e.g., a gear box) or the like.

In some cases, a permanent electrical connection to provide electrical power to the electronics of the intermittent pilot combustion controller and system 200 may not be practical. In such cases, the intermittent pilot combustion controller and system 200 may be configured to receive power via the thermal electric and/or photoelectric device 160 during normal operation. In some instances, the thermal electric and/or photoelectric device 160 may be used to provide power to the electrically actuated components of the water heater 201, such as the controller 110, the igniter 140 and/or valve control relays and/or solenoids associated with the valves 130, and the like. In some cases, the thermal electric device 160 may include one or more thermopiles capable of generating an electrical current when exposed to heat, such as when exposed to the flame of the pilot burner 157 and/or the main burner 159. The thermal electric and/or photoelectric device 160 may be used to generate electrical energy to provide power to the controller 110 and/or other electrical components (e.g., the valves 130, the igniter 140, the damper 280, etc.). In some cases, the electrical energy generated by thermal electric and/or photoelectric device 160 may be stored in the runtime power source 120 and/or the ignition start-up power sources 170A, 170B.

In some cases, the electrical current generated by the thermal electric and/or photoelectric device 160 may be used to control, either directly or indirectly, the operation of an interlock circuit that may at least partially control the operation of the pilot valve 137 and/or the main valve 139.

In some cases, the pilot valve 137 and/or the main valve 139 may be a normally-closed devices. For example, a current generated by the thermal electric and/or photoelectric device 160 may be provided to the pilot valve 137 and/or the main valve 139 to maintain the valve in an open position. In some cases, when the flame of the main burner, the pilot burner, or both is lost, the thermal electric and/or photoelectric device 160 will stop generating a current. A current loss may cause the one or both of the pilot valve and the main valve to close to prevent a buildup of unburned fuel in the burner assembly 150. In some cases, the controller 110 may monitor the electrical energy generated by the thermal electric and/or photoelectric device 160 to monitor the operation of the one or more burners of the burner assembly 150. For example, the controller 110 may monitor the electrical energy produced by the thermal electric and/or photoelectric device 160 to determine whether an initiated ignition sequence was successful and/or whether a flame on the pilot burner 157 and/or the main burner 159 is present. In some cases, the controller 110 may use one or more other devices to determine whether an initiated ignition sequence was successful, such as a flame rectification device, an optical sensor (e.g., a visible light sensor, an ultra-violet light sensor, an infra-red light sensor, etc.), and/or another thermal sensing device such as a thermistor or a thermocouple.

The electrical power generated by the thermal electric and/or photoelectric device 160 may be used to provide power to the controller 110 and/or the damper 280. In some cases, the power provided by thermal electric and/or photoelectric device 160 may be at a voltage and/or current level different than one necessary to use with the one or more electrical components of the water heater 201. As such, it is contemplated that the water heater 201 may include a power converter 180 that may convert electrical energy produced by the thermal electric and/or photoelectric device 160 having a first voltage level (e.g., less than 1 Volt) to a second voltage level (e.g., greater than 10 Volts). In some cases, the power converter 180 may include circuitry to convert a DC voltage provided by the thermal electric and/or photoelectric device 160, the runtime power source 120, and/or the start-up power source 170 from a DC voltage to an AC voltage (e.g., from about 3 Volts DC to 24 Volts AC), which may be desirable for powering the igniter 140.

As discussed, the controller 110 may be configured to control an ignition sequence of the igniter 140 based on a user input and/or to maintain a desired temperature set point. In some cases, the controller 110 may receive a user command to ignite a flame in the pilot burner 157 from a switch (e.g., a momentary switch 194) and/or from an adjustment of the adjustment element 197. In some cases, the controller 110 may be configured to monitor a temperature signal from the one or more temperature sensors 196, where the corresponding temperature signals correspond to the temperature of the media to be maintained at the desired temperature set point (e.g., water in the water tank 250). During normal operation, the runtime power source 120 may store sufficient energy to power the controller 110, the valves 130, the damper 280, the igniter 140, and the like. In some cases, when the thermal electric device 160 is heated enough by the pilot flame and/or the main flame to generate sufficient electricity, the thermal electric device 160 may take over from the runtime power source 120 and/or recharge the runtime power source 120. In some cases, the runtime power source 120 may be recharged using energy generated by the thermal electric device 160. However, during an initial ignition after installation or after an extended duration of non-use, the energy stored in the runtime power source 120 may be below a pre-determined threshold level, which may in insufficient to power the various devices of the water heater 201. For example, after a fresh installation or after an extended duration of non-use, the runtime power source 120 may not have sufficient energy stored to complete a successful ignition sequence.

In some cases, a user may use a hand-held igniter to ignite the pilot flame. However, the gas appliance (e.g. water heater 201) may include a burner assembly 150 where the pilot burner 157 (and the main burner 159) may be enclosed and/or sealed such that a user does not have ready access to the pilot burner 157 (or the main burner 159). In other cases, the water heater 201 may include an igniter, such as a piezo igniter. A user may manually depress a button to activate the piezo igniter, while at the same time hold down a gas button to open the pilot valve. Once the pilot flame is ignited, the user may continue to hold down the gas button until the pilot flame can heat a thermoelectric device (e.g., a thermopile) or activate a photoelectric device sufficiently to generate enough power to hold the pilot valve open, which in some cases, can take an extended period of time.

In some cases, the water heater 201 may include a momentary switch 194 that activates the start-up power sources 170A, 170B via the controller 110. Activation of the momentary switch 194 may cause the controller 110 to receive power from the start-up power sources 170A, 170B and to initiate a pilot flame ignition sequence by commanding a one or more valves 130 to provide gas to a burner assembly 150 and by activating the igniter 140 to ignite the pilot flame in the burner assembly 150. During this ignition sequence, power from one or more of the start-up power sources 170A, 170B may be used. The start-up power sources 170A, 170B, like the runtime power source 120, may be rechargeable, such as being recharged with energy received from the thermal electric device and/or photoelectric device 160, but this is not required. In some cases, the start-up power sources 170A, 170B and/or the runtime power source 120 may be rechargeable using an external device, such as an AC to DC converter. Use of the start-up power source 170A, 170B may reduce costs associated with a gas powered appliance and/or improve the user experience. For example, costs associated with the piezo igniter may be reduced and/or eliminated. Further, a user may not be required to manually ignite the pilot flame with a piezo igniter and/or by depressing a button to open the pilot valve until the pilot flame is ignited. Rather, the user may initiate an initial ignition sequence by, for example, simply depressing the momentary switch 194.

In some cases, the start-up power source 170A may be installed within the intermittent pilot combustion controller and system 200, and may be a battery and/or a capacitor installed adjacent the controller 110. The start-up power source 170A may be installed and/or pre-charged prior to installation into the illustrative intermittent pilot combustion controller and system 200. In some cases, the start-up power source 170A may be permanently installed (e.g., a capacitor, a rechargeable battery), or may be removable, such as a removable rechargeable battery configured to fit in a battery holder. In some cases, the start-up power source 170A may be installed within illustrative intermittent pilot combustion controller and system 200 at a location remote form the controller 110. For example, and in some cases, the motor 285 of the damper 280 may be used as the start-up power source 170A. In some cases, the start-up power source 170B may be removably coupled and separate from the illustrative intermittent pilot combustion controller and system 200 and may be electrically coupled to the controller using a port 272 at the exterior of the illustrative intermittent pilot combustion controller and system 200. For example, the start-up power source 170B may include one or more devices capable of providing electrical power, such as a battery, a capacitor, an AC to DC converter and/or a hand powered electrical generator, as desired.

The different possible start-up power sources 170A, 170B may allow for one or more different configurations of the intermittent pilot combustion controller and system 200 (e.g., the water heater 201). For example, a water heater 201 may include a battery and/or another pre-charged energy storage device (e.g., a capacitor, a super capacitor, etc.) built into the control section 205 as the start-up power source 170A. The momentary switch 194 may provide a cost effective way for a user to initiate an initial ignition sequence. For example, the momentary switch 194 may be incorporated into a flexible region of the enclosure of the water heater 201. When the user presses on this flexible region, the momentary switch may complete an electrical circuit between the start-up power source 170A and the controller 110. The controller 110, sensing this connection, may initiate an ignition sequence of the pilot burner 157 using power from the start-up power source 170A.

Similarly, the start-up power source 170B may be used in addition to, or in place of, the start-up power source 170A. For example, it is contemplated that a user may temporarily connect a pre-charged power source, such as a battery, a hand-powered generator and/or an AC line adapter (e.g., an AC to DC power converter) to port 272 at the exterior of the water heater 201. In such cases, the user may use the same battery, hand-powered generator and/or AC line adapter for multiple installations. In these instances, costs may be reduced as a battery or the like would not need to be installed with every installation. In some cases, the start-up power source 170A and/or 170B may be used without a momentary switch, where the controller 110 may initiate an ignition sequence once a set-point is set using the adjustment element 197 or the like.

In some cases, the user may be able to use damper 280, more specifically the motor 285 of the damper 280, as the start-up power source 170A. For example, the user may turn the damper by hand (or with a drill or the like) between the open and closed position to turn the motor and generate enough power for the controller to initiate the ignition sequence.

The start-up power sources 170A, 170B and/or the runtime power source 120 may have a limited amount of energy available to operate the controller 110 and/or other electrical circuits when the thermal electric and/or photoelectric device 160 is not supplying energy, such as when the gas-powered appliance is in a standby mode. In some cases, the controller 110 may be configured to control and/or optimize the ignition sequence (e.g., the initial ignition sequence and/or subsequent ignition sequences) using an algorithm stored in at least a portion 123 of the memory 115. The controller 110 may operate using instructions stored in the memory 115 to manage the life of the runtime power source 120 and/or the start-up power source 170. For example, the controller 110 may be configured to determine a voltage level and/or a number of sparks allowed to ignite the pilot flame.

In some cases, the controller 110 may be configured to determine and/or learn an amount of time necessary to purge air from the line between the valves 130 and the burner assembly 150. This time may vary depending on conditions. In some cases, the longer the valves 130 have been closed, the longer it may take to purge air from the lines. For example, during normal operation, the purge time may be relatively short, such as about 15 seconds, about 30 seconds, under 1 minute, etc. However, if the intermittent pilot combustion controller and system experiences an extended duration of non-use, purge times may significantly increase, such as over 1 minute, about 2 minutes, between 2 and 5 minutes, etc.). Once the controller 110 determines and/or learns the amount of time expected to purge the air from the lines, the controller 110 may delay providing a spark to the burner assembly 150 until the purge time expires, and gas is expected to be present at the burner assembly 150. This may help reduce the energy expended from the runtime power source 120 and/or the start-up power sources 170A, 170B.

In some cases, the controller 110 may learn or otherwise determine or estimate one or more purge times under various operating conditions, and may store the one or more purge times in the memory 115. The controller 110 may estimate a first purge time associated with an initial ignition sequence, such as the first ignition sequences after installation or after an extended duration of non-use. The controller 110 may estimate a second purge time associated with an ignition sequence used during normal operation. The controller 110 may determine a relationship between the duration of time between ignition sequences and the one or more purge times, such as by using information about volume of the supply lines, the volume of the valves 130 and/or the volume of the combustion chamber of the burner assembly 150. The controller 110 may be configured to store the first purge time, the second purge time and/or other information about the relationship between the purge times such as times between ignition cycles in the data portion 127 of the memory 115.

After the installation of an intermittent pilot combustion controller and system 200, a relatively long purge time may be used to remove the air from the fuel supply line 230, the valves 130 and/or the burner assembly 150. During the initial ignition sequence, the controller 110 may read a default purge time from the memory 115, command the pilot valve 137 to open, and wait for the default purge time to expire before initiating a spark by the igniter 140. If the ignition sequence is unsuccessful, the controller may wait for a predetermined time before initiating another spark. In one example, the controller 110 may manage the energy usage of the igniter 140 by making incremental increases to the purge time, such as when the necessary purge time is unknown. For example, the controller 110 may use a short delay between sparks and gradually increase the delay time between sparks. The controller 110 may be configured to adjust the delay time using instructions designed to keep the required purge time to a minimum. In some cases, the controller 110 may determine that an ignition sequence was successful by monitoring a signal received from the thermal electric device 160. For example, the controller 110 may determine that an ignition sequence was successful when the energy (e.g., a voltage, a current, etc.) received from the thermal electric device 160 is greater than a pre-determined threshold.

The delay time between sparks can be the same as, or different than, the purge time. In some cases, the controller 110 may change the delay time (e.g., increase the time, decrease the time, etc.) using a mathematical equation between unsuccessful ignition attempts. For example, the delay time may increase (e.g., from about 30 seconds to about 1 minute) to save energy stored in the start-up power sources 170A, 170B and/or the runtime power source 120. In some cases, the controller may decrease the purge time (e.g., from about 1 minute to about 30 seconds) after a successful ignition sequence. After an unsuccessful ignition attempt, subsequent sparks may be commanded by the controller 110. In some cases, the controller 110 may attempt to ignite the pilot burner 157 until a specified condition is met, such as a successful ignition sequence, a maximum number of attempts, or a specified time has elapsed without a successful ignition of the pilot burner 157 (or the main burner 159). The controller 110 may store an indication of whether the ignition sequence was successful or unsuccessful to the memory 115. In one example, the controller 110 may store an initial purge time, a runtime purge time, a delay time between ignition attempts, a maximum length of time to attempt ignition, a number of ignition attempts before a successful ignition, a maximum number of ignition attempts, a starting energy level for the igniter spark, an energy level for a spark that successfully ignited the pilot burner, an energy level of a spark during an unsuccessful ignition attempt, a maximum energy level for the sparks generated by the igniter 140, and/or any other suitable parameter, as desired.

In some cases, the purge time and/or other time delays may adversely affect the efficiency ratings of an intermittent pilot combustion controller and system 200. For example, the controller 110 of a water heater 201 may initiate an ignition sequence in response to a call for heat. The call for heat may include one or more signals received from a user (e.g., via the momentary switch 194 and/or the adjustment element 197) and/or may be generated in response to a temperature signal received from the one or more temperature sensors 196. Any delay between the call for heat and the ignition of the main burner 159 may effectively reduce the efficiency ratings of the water heater 201. For example, a long delay between a temperature change command (e.g., such as a set point change at the adjustment element 197) may reduce the water heater's First Hour Rating. This delay may include the above-mentioned purge time and/or another delay time, such as a delay time associated with heating the thermal electric device 160. In some cases, after a successful ignition of the pilot flame, the pilot flame must heat the thermal electric device and/or photoelectric device 160 above a specified temperature before the thermal electric device 160 may generate sufficient energy to energize, for example, the main valve 139 to provide fuel to the main burner 159. The time to heat the thermal electric device 160, which may be from about 30 seconds to about 60 seconds, may reduce the First Hour Rating of the water heater 201, the overall efficiency of the water heater 201, or both.

To compensate for the heating time of the thermal electric device 160 and/or the purge time, the controller 110 may use and/or determine one or more pre-start parameters. For example, a pre-start parameter may correspond to a sensed temperature at which the controller 110 may initiate an ignition sequence, such as even before the programmed temperature setpoint is reached. To determine the temperature associated with such a pre-start parameter, the controller 110 may monitor the temperature signal from the one or more temperature sensors 196 to determine a rate of change of the temperature of the water in the water tank 250. The controller 110 may then process a mathematical equation to determine the temperature at which an ignition sequence can be initiated to compensate for the delay times included with the intermittent pilot combustion controller and system 200. For example, the controller 110 may calculate the pre-start temperature based on the rate of change of the water temperature in the water tank 250, the expected purge time (which may be based on the time since the last cycle of the main burner 159), and the time necessary for the thermal electric device 160 to generate sufficient energy to open the main valve 139. Using this pre-start temperature, the pilot flame may be lit and capable of igniting the main burner when the water in the water tank 250 drops down and actually reaches the user defined temperature setpoint.

In some cases, the controller 110 may be configured to automatically retry an ignition sequence to ignite a flame on the pilot burner after a failed ignition sequence. Under some conditions, this may cause the energy stored within the runtime power source 120, and/or the start-up power sources 170A, 170B, to become drained. The controller 110 may be configured to operate using an algorithm to monitor and/or manage the energy stored in these power sources. For example, the controller 110 may be configured to adjust one or more portions of an ignition sequence to extend the stored energy. For example, the controller 110 may be configured to increase a delay between successive ignition sequences, to adjust an energy level used by the igniter to generate a spark, and/or to prevent further attempts to ignite the pilot flame after a predetermined time and/or attempts at ignition. In cases where the controller 110 stops automatically retrying to ignite a flame in the burner assembly 150, the controller 110 may be configured to wait for an externally generated command to ignite the pilot flame, such as a command received from a user (e.g., a change in the setpoint temperature using the adjustment element 197, an ignition command from the momentary switch 194, a temperature command received from a thermostat and/or another temperature signal received from the one or more temperature sensors 195, and the like. In one example, the controller 110 may be configured to monitor the temperature of water within the water tank 250, and if a water draw is detected, such as a decrease in water temperature outside of an expected rate of change, the controller 110 may initiate another ignition sequence.

In some cases, the controller 110 may be configured to increase a delay time between ignition attempts to help extends the stored energy in the runtime power source 120 and/or the start-up power sources 170A, 170B. In one example, if an ignition sequence fails, the controller 110 may be configured to wait for a first specified duration (e.g., about 5 minute, about 10 minutes, etc.) before initiating another ignition sequence. After subsequent failed ignition sequences, the controller may increase the time delay between ignition attempts. In some cases, the time delay may be incrementally increased after each failed ignition sequence. The controller 110 may stop automatically retrying the ignition sequence after a specified threshold has been reached, such as a maximum time delay between attempts (e.g., about 1 hour, about 2 hours, etc.) or a maximum number of attempts has been reached (e.g., five attempts, ten attempts, etc.) In some cases, the controller 110 may be configured to adjust such a threshold based on the current energy level and/or the current capacity of the power source (e.g., the runtime power source 120 and/or the start-up power sources 170A, 170B). In one example, if the energy level and/or capacity of the runtime power source 120 and/or the start-up power sources 170A, 170B is down to a particular level (e.g. down to 50%), the controller 110 may decrease the number of allowable attempts (e.g., from 5 attempts to 3 attempts). If the energy level and/or capacity of the runtime power source 120 and/or the start-up power sources 170A, 170B falls below a lower limit (e.g., below about 40%), the controller 110 may be configured to only allow manually initiated ignition sequences (e.g., a user input from the momentary switch 194, a set point change at the adjustment element 197, etc.).

In some cases, the controller 110 may adapt the ignition sequence to reduce the energy usage from the power source (e.g., the runtime power source 120 and/or the start-up power sources 170A, 170B etc.). The controller 110 may be configured to store an indication of the success and/or failure of one or more ignition sequences in the memory 115. As discussed above, the controller 110 may be configured to adjust one or more parameters to extend the use of the energy stored in the runtime power source 120, and/or the start-up power sources 170A, 170B. For example, the controller 110 may be configured to adjust the energy used by the igniter 140 when generating a spark. In some cases, the voltage required by the igniter to generate a spark may be much greater than the voltage provided by the runtime power source 120, the start-up power sources 170A, 170B, or the thermal electric and/or photoelectric device 160. In such cases, the voltage level may be increased using the power converter 180. In some cases, the spark circuitry 142 and/or the power converter 180 may include a DC to DC power converter that may be configured to increase a voltage at a first level (e.g., about 450 millivolts, about 700 millivolts, about 3 volts, about 9 volts, etc.) to a voltage at a second level (e.g., about 24 volts, about 150 volts, between about 150 volts and about 180 volts, etc.). In some cases, the power converter 180 may allow for a configurable second voltage level provided at an output. This configurable voltage level may be provided to the igniter 140 for spark generation by the spark rod 145.

In one example, the controller 110 may be configured to adjust the voltage level supplied to the igniter 140 to a determined minimum level that allows for a successful ignition of the pilot burner 157. The controller 110 may be capable of adjusting the voltage level over two or more ignition sequences until an optimal and/or minimum voltage level is determined based on the success and/or failure of the two or more ignition sequences. For example, the controller 110 may determine a voltage level, lower than a maximum voltage level, at which a single spark may ignite a flame in the pilot burner 157. In some gas powered appliances, multiple sparks may be necessary for igniting a flame in the pilot burner 157. In such cases, the controller 110 may increase the spark voltage and/or increase a sparking rate to help improve the operation of the intermittent pilot combustion controller and system 100 and reduce energy consumption from the runtime power source 120 and/or the start-up power sources 170A, 170B.

In an example, the controller 110 may control the power converter 180 to provide energy to the igniter 140. The controller 110 may first set the spark voltage level at a default level, which may be read from the memory 115. After initiating the spark, the controller 110 may wait for a predetermined time to receive information about whether the ignition sequence was successful or unsuccessful. For example, the controller 110 may monitor a signal produced by the thermal electric and/or photoelectric device 160, as described above. If the ignition was successful, the spark voltage level may be stored in the memory as being successful, and the controller 110 may define a second voltage level for use in a subsequent ignition sequence. In some cases, the second voltage level may be less than the first voltage level (e.g., the default voltage level). In such instances, the energy required from the power source (e.g., the runtime power source and/or the start-up power sources 170A, 170B) may be reduced.

If an ignition sequence was unsuccessful, the controller 110 may store the voltage level that was used with an indication of an unsuccessful ignition sequence. The controller 110 may then define a third voltage level, greater than the voltage level used for the previous unsuccessful ignition sequence. The controller 110 may incrementally increase the voltage level after successive unsuccessful ignition sequences, until a successful ignition occurs or a maximum voltage level is reached. If the spark voltage level reaches the maximum voltage level, and the ignition sequence still fails, the controller 110 may cause the igniter to generate two or more sparks during an ignition sequence. In some cases, the controller 110 may increase the number of sparks until a maximum number of sparks has been reached, a maximum ignition time threshold has been reached, or a successful ignition occurs. The controller 110 may store the number of sparks and/or the voltage level necessary for a successful ignition of the pilot flame. The controller 110 may modify one or more of the voltage level used by the igniter, the number of sparks used to ignite the pilot flame, and/or the time between sparks after a successful or unsuccessful ignition sequence until an optimal energy usage is found. In one example, the controller 110 may modify the spark energy and/or number of sparks of the igniter 140 until the controller 110 determines a minimum energy usage from the runtime power source 120 or the start-up power sources 170A, 170B.

Figure 3:
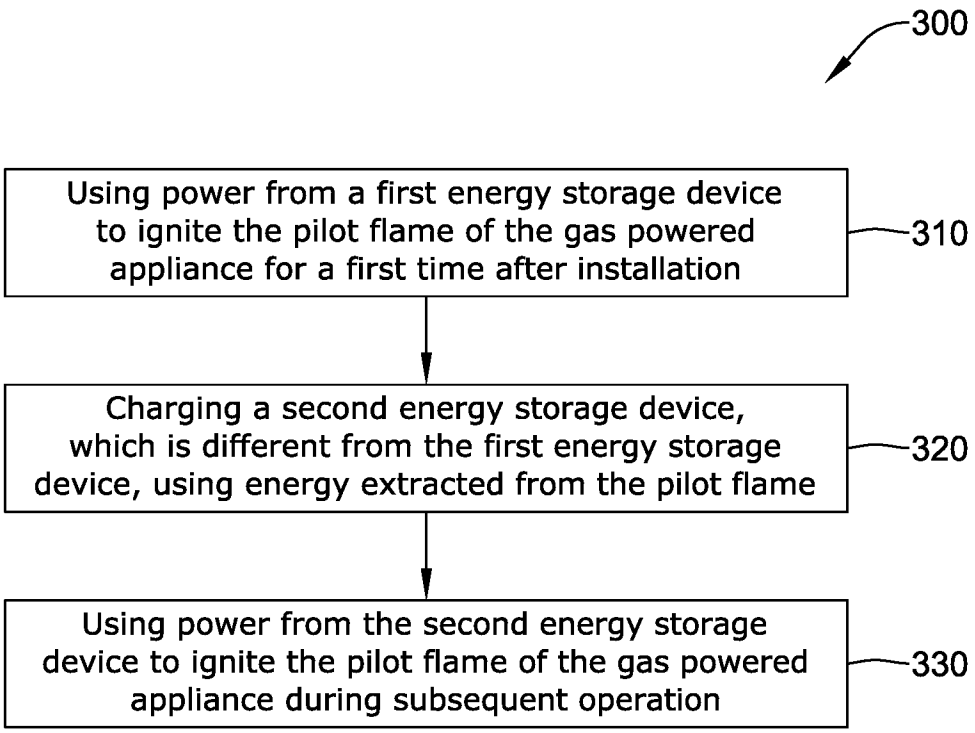
FIG. 3 shows an illustrative method for igniting a pilot flame of an intermittent pilot combustion system for a first time after installation or after an extended period of non-use.

FIG. 3 shows an illustrative method for igniting a pilot flame of an intermittent pilot combustion system for a first time after installation and/or after an extended period of non-use. At 310, the pilot flame of a gas-powered appliance may use power received from a first energy storage device to ignite the pilot flame of the gas-powered appliance for a first time after installation and/or after an extended period of non-use. At step 320, a second energy storage device, which is different from the first energy storage device, is charged using energy extracted from the pilot flame. At 330, power received from the second energy storage device is used to ignite the pilot flame of the gas-powered appliance during subsequent operation of the gas-powered appliance. In some cases, the first energy storage device may be a pre-charged power source, such as a pre-charged capacitor, a pre-charged rechargeable battery, a primary battery, a line voltage, and/or a hand powered generator. The second energy storage device may a rechargeable battery, a capacitor or any other suitable charge storage device as desired, capable of being recharged from a thermal electric and/or photoelectric device 160.

Figure 4:
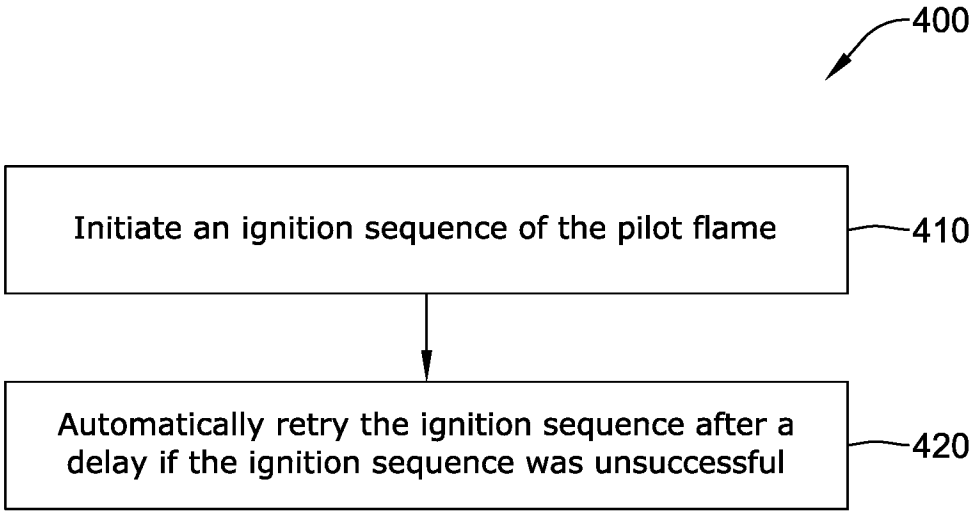
FIG. 4 shows an illustrative method for igniting a pilot flame of a gas-powered appliance.

FIG. 4 shows an illustrative method 400 for igniting a pilot flame of a gas-powered appliance. At 410, an ignition sequence may be initiated to ignite a pilot flame on a pilot burner 157. In some cases, the ignition sequence may be initiated by an external source, such as by a user operating a momentary switch 194 and/or an adjustment element 197. In some cases, the controller 110 may initiate an ignition sequence by monitoring a signal, such as one or more temperature signals received from the one or more temperature sensors 196. At 420, if the ignition sequence was unsuccessful in igniting a pilot flame, the ignition sequence may be repeated after a delay. In some cases, the controller 110 may use a delay of a specified time. In some cases, the controller 110 may adjust the duration of the delay. The automatically retrying step may be repeated until the ignition sequence is successful, may be repeated for a predetermined amount of time, or may be repeated for a predetermined number of times. These are just some examples. In some cases, the automatically retrying step may not be repeated when the power level of the runtime power source 120 and/or the start-up power source 170 is less than a specified threshold value. In some cases, the controller 110 may repeat the automatically retrying step for a period of time. In some instances, after the specified period of time has elapsed, the controller 110 may retry the ignition sequence after a sensed temperature meets one or more conditions, such as the temperature reaching a predetermined threshold.

Having thus described several example implementations of the present disclosure, those of skill in the art will readily appreciate that yet other implementations may be made and used within the scope of the claims hereto attached. It will be understood, however, that this disclosure is, in many respect, only illustrative. Changes may be made in details, particularly in matters of shape, size, and arrangement of parts without exceeding the scope of the disclosure. The disclosure's scope is, of course, defined in the language in which the appended claims are expressed.

What is claimed is:

1. A method of igniting a pilot flame of a gas-powered appliance having a flame powered intermittent pilot ignition system, the method comprising:

using power from a first power source to ignite the pilot flame of the gas-powered appliance in a first ignition following installation of the gas-powered appliance; and using power from a second power source and not the first power source to ignite the pilot flame of the gas-powered appliance after the first ignition.

2. The method of claim 1, wherein the first power source comprises a pre-charged capacitor.

3. The method of claim 1, wherein the first power source comprises a battery.

4. The method of claim 1, wherein the first power source comprises a line voltage.

5. The method of claim 1, wherein the first power source comprises a hand powered generator.

6. The method of claim 1, wherein the second power source comprises a rechargeable battery.

7. The method of claim 1, wherein the second power source comprises a capacitor.

8. The method of claim 1, further comprising:

receiving an ignition command from a user via a momentary switch to ignite the pilot flame of the gas-powered appliance for the first ignition, wherein the ignition command causes power from the first power source to ignite the pilot flame of the gas-powered appliance.

9. The method of claim 1, further comprising:

charging the second power source from a thermal electric and/or photoelectric device that is exposed to the pilot flame during subsequent operation of the gas-powered appliance following the first ignition.

10. The method of claim 9, further comprising using power from the first power source to ignite the pilot flame of the gas-powered appliance if, during subsequent operation of the gas-powered appliance following the first ignition, energy stored in the second power source falls below a threshold level.

11. A method of igniting a pilot flame of a gas-powered appliance having a flame powered intermittent pilot ignition system, the method comprising:

using power from a first power source to ignite the pilot flame of the gas-powered appliance for initial startup after installation of the gas-powered appliance; and using power from a second power source and not the first power source to ignite the pilot flame of the gas-powered appliance after initial startup of the gas-powered appliance.

12. The method of claim 11, further comprising:

charging the second power source from a thermal electric and/or photoelectric device that is exposed to the pilot flame during subsequent operation of the gas-powered appliance following initial startup; and using power from the first power source to ignite the pilot flame of the gas-powered appliance during subsequent operation of the gas-powered appliance if energy stored in the second power source falls below a threshold level.

13. The method of claim 11, wherein the first power source comprises a pre-charged capacitor.

14. The method of claim 11, wherein the first power source comprises a battery.

15. The method of claim 11, wherein the first power source comprises a line voltage.

16. The method of claim 11, wherein the first power source comprises a hand powered generator.

17. The method of claim 11, wherein the second power source comprises a rechargeable battery.

18. The method of claim 11, wherein the second power source comprises a capacitor.

19. A method of igniting a pilot flame of a gas-powered appliance having a flame powered intermittent pilot ignition system, the method comprising:

using power from a first power source to ignite the pilot flame of the gas-powered appliance for initial startup after installation of the gas-powered appliance; and using power from a thermal electric and/or photoelectric device that is exposed to the pilot flame during subsequent operation of the gas-powered appliance following initial startup, and not the first power source, to ignite the pilot flame of the gas-powered appliance after initial startup of the gas-powered appliance.

20. The method of claim 19, further comprising:

charging a second power source using power from the thermal electric and/or photoelectric device; and using power from the first power source to ignite the pilot flame of the gas-powered appliance during subsequent operation of the gas-powered appliance following initial startup if energy stored in the second power source falls below a threshold level.

* * * * *